US005743710A

United States Patent [19]

Yapp

[11] Patent Number: 5,743,710

[45] Date of Patent: Apr. 28, 1998

[54] STREAMLINED ANNULAR VOLUTE FOR CENTRIFUGAL BLOWER

[75] Inventor: Martin G. Yapp, Needham, Mass.

[73] Assignee: Bosch Automotive Motor Systems Corporation, Waltham, Mass.

[21] Appl. No.: 609,062

[22] Filed: Feb. 29, 1996

[51] Int. Cl.[6] ..... F04D 29/44

[52] U.S. Cl. ..... 415/208.2; 415/211.2

[58] Field of Search ..... 415/219.1, 211.2, 415/208.1, 208.2, 182.1, 185, 187, 220

[56] References Cited

U.S. PATENT DOCUMENTS

| | | | |
|---|---|---|---|
| 1,042,506 | 10/1912 | De Vallat | 415/219.1 |
| 2,538,739 | 1/1951 | Troller | 415/220 |
| 2,952,403 | 9/1960 | Stalker | 415/220 |
| 3,204,562 | 9/1965 | Norquist | 415/219.1 |
| 3,243,102 | 3/1966 | McMahan | 415/208.2 |
| 4,427,338 | 1/1984 | Furst | 415/208.2 |
| 4,802,821 | 2/1989 | Krietmeier | 415/211.2 |
| 4,900,228 | 2/1990 | Yapp . | |
| 4,946,348 | 8/1990 | Yapp . | |
| 5,114,317 | 5/1992 | Cohen | 415/182.1 |
| 5,203,674 | 4/1993 | Vinciguerra | 415/208.1 |
| 5,487,644 | 1/1996 | Ishigaki et al. | 415/182.1 |

FOREIGN PATENT DOCUMENTS

| | | | |
|---|---|---|---|
| 2624923 | 6/1989 | France | 415/219.1 |

OTHER PUBLICATIONS

PCT Search Report.

*Primary Examiner*—Christopher Verdier

*Attorney, Agent, or Firm*—Fish & Richardson P.C.

[57] ABSTRACT

Centrifugal blower with improved envelope geometry, and improved impeller top and hub plate design.

18 Claims, 3 Drawing Sheets

STREAMLINED ANNULAR VOLUTE FOR CENTRIFUGAL BLOWER

BACKGROUND OF THE INVENTION

This invention relates to centrifugal blowers and fans.

Centrifugal blowers and fans generally include an impeller that is driven by an electric motor to rotate in a predetermined direction in a housing. The impeller has curved blades which draw air in axially (along the impeller's axis of rotation) and discharge air outwardly away from the axis.

Impeller blades are said to be forward or rearwardly curved, depending on the angle of the blade tip relative to a tangent to the blade at the tip. This angle is called the "blade exit angle". If the blade exit angle is greater than 90°, the impeller is said to have forwardly curved blades; if the blade exit angle is less than 90°, the impeller is said to have rearwardly curved blades. The impeller blades may be housed in a wheel that includes an annular top (or front) plate forming the fan inlet, and a rear (or hub) plate.

Centrifugal blowers are used in a variety of applications which dictate a variety of design points for pressure difference, airflow volume, motor power, motor speed, space constraints, inlet and outlet configuration, noise, and manufacturing tolerances. Often centrifugal blowers are positioned to move air through an adjacent (usually downstream) heat exchanger which presents substantial flow resistance. Some specific applications for centrifugal blowers include air conditioners and auto climate control.

One particular centrifugal blower construction disclosed in U.S. Pat. Nos. 4,900,228 and 4,946,348 includes two stages of stator blades to remove swirl from airflow exiting the impeller and to turn the airflow axially.

Each of the above U.S. patents is hereby incorporated by reference.

SUMMARY OF THE INVENTION

I have discovered certain design modifications to annular volute envelopes and blower wheels that significantly improve blower performance, particularly for blowers with rearwardly curved blades. Without wishing to bind myself to a detailed theory, these modifications may reduce internal flow impedance of the volute and other blower assembly components and therefore permit greater flow/pressure ratios at peak operating efficiency.

CONTROLLING CONE ANGLES

One aspect of the invention generally features controlling the cone angles of the blower wheel plates, specifically the cone angle of the top plate and of the hub plate. This aspect of the invention is particularly advantageous in assemblies characterized by an annular envelope having a flow-directing envelope section (behind an inlet section), in which there are two stages of airfoil vanes to turn and diffuse airflow in the envelope. As described in greater detail below, the cone angle of the top plate should be between 12° and 30° (preferably between 16° and 25°). The cone angle of the hub plate should be between 0° and 12° (preferably between 3° and 10°). I find that such control of the cone angles improves performance substantially.

CONTROLLING REAR ENVELOPE SURFACES

Another aspect of the invention generally features a centrifugal blower assembly in which the inner surface of the envelope includes a rearward terminal section (described in greater detail below) that is convex and curves gradually as it progresses rearwardly from a generally axial segment to a rear wall segment that is transverse to the axis and is adjacent to the flow resistance, e.g., a heat exchanger. Without wishing to limit myself to a particular theory, the above wall geometry may reduce inefficiency by controlling flow separation in the envelope.

As described below, the convex rear section of the inner envelope wall may have a gradually increasing radius of curvature moving rearwardly along the axis from a short radius connected to the generally axial section of the inner envelope wall. The change in radius of curvature between two given points may be established by determining the angle $\phi$ between tangents at the points ($T_1$ and $T_2$). See FIG. 3. The radius of curvature of the surface may increase at a generally constant rate in this region.

The camber of the convex wall section may be relatively large (between 70° and 90°) when measured from the end of the generally axial segment to a point at which the surface has a radius of 0.5 Rh (Rh is the radius of the generally axial segment of the inner envelope surface). Connecting the generally axial wall section with the section of increasing radius, the convex wall section may have a segment that is generally a radius of a circle (e.g., a radius at least 0.1 R where R is the radius of the inner surface of the outer envelope wall) or that is elliptical. Alternatively, the convex region may be a shallow cone e.g. having a camber of 5°–10° in this region.

In preferred embodiments, the assembly may include multiple (two) stages airfoil vanes, one stage being positioned axially ahead of the other stage, and at least a portion of vanes of the second stage extending along at least part of the convex rearwardly terminal section of the inner envelope surface described above.

One advantage of this aspect of the invention is the improved airflow characteristics through the heat exchanger. As a result of these improvements, the impeller blades may be designed with an increased pitch angle to yield a higher flow coefficient.

I have also found that blower performance is improved by designing a discrepancy between the hub diameters of the first and the second inlet stators. For injection molded fans, these diameters will differ by no more than two percent (or the wall thickness of the part). Fans characterized by this hub diameter exhibit increased efficiency and reduced noise due to reduced power consumption. Accordingly, a third aspect of the invention features a centrifugal blower assembly in which the envelope includes two stages of airfoil vanes positioned in the annular envelope to turn and diffuse airflow in the envelope, in which the first (upstream) stage of stator vanes has a hub diameter that is between 1% and 4% larger than the second stage of stator vanes.

Other features and advantages of the invention will be apparent from the following description of preferred embodiments, and from the claims.

DESCRIPTION OF PREFERRED EMBODIMENTS

Figure 1:
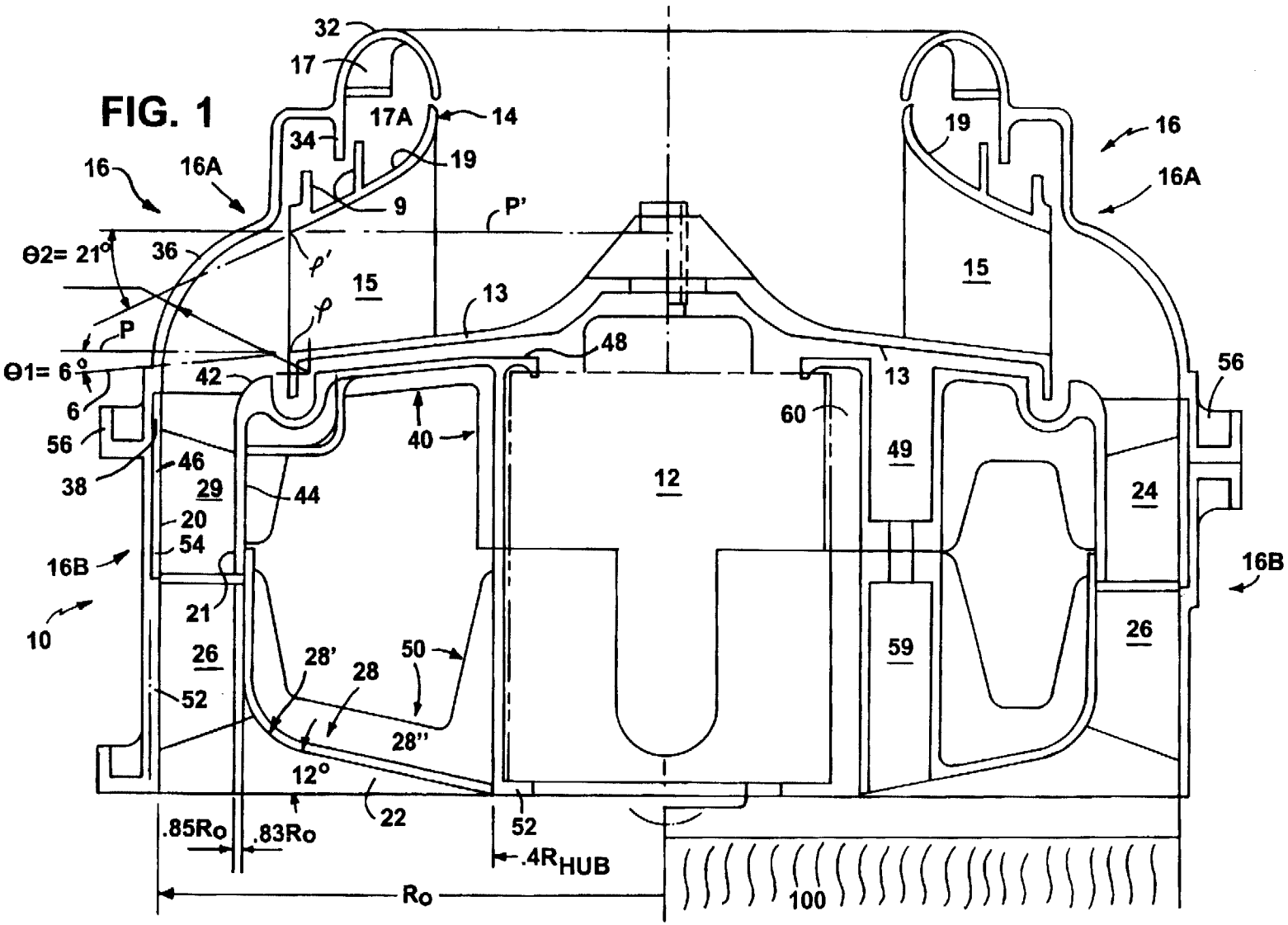
FIG. 1 is a section of one side of a centrifugal blower assembly and adjacent heat exchanger.

In FIG. 1, centrifugal blower assembly 10 draws air in axially and discharges it into heat exchanger (evaporator)

100, only half of which is illustrated. Blower assembly 10 includes a motor 12 connected to rotate an impeller wheel 14 which draws air in axially and discharges it outwardly. Envelope assembly 16 is positioned around the impeller to guide airflow discharged from the impeller to heat exchanger 100.

Envelope assembly 16 has two major sections: an axially forward inlet section labeled 16A; and a flow-directing section 16B which directs airflow received from the impeller through an envelope bounded by surfaces 20 (the outer envelope surface) and 21 (the inner envelope surface). The envelope extends rearwardly to an outlet 22 adjacent the heat exchanger 100.

Within the envelope are two stages of airfoil vanes which turn the airflow away from tangential and toward axial, and produce a lower velocity (higher pressure). The first stage 24 is axially ahead of the second stage 26. The general function of these stators is described in U.S. Pat. Nos. 4,900,228 and 4,946,348 referenced above.

CONE SURFACES ON IMPELLER WHEEL

Impeller wheel 14 has multiple (over ten) blades 15 (one shown) spanning between an annular top (or front) plate 19 and a rear or hub plate 13. The shape of these plates is important to blower performance. Specifically, the plates are slightly convex (e.g. cone shaped). The degree of hub plate curvature can be depicted by the hub plate cone angle $\theta_1$ between a line L tangent to the cone and line Pl perpendicular to the axis through a point p on the blade tip. See FIG. 2. The hub plate angle generally is between 0° and 12° preferably between 3° and 10°. The embodiment depicted has a hub plate cone angle of about 6°±2°.

Similarly, the degree of top plate curvature can be depicted by the top plate cone angle $\phi_2$ between line L' tangent to the top plate cone and the plane P' perpendicular to the axis through point p' on the tip of the blades. The top plate angle should be between 12° and 30°, preferably between 16° and 25°. The embodiment depicted has a top plate cone angle of about 21°±2°.

Such impellers can be injection molded plastic according to techniques known to those in the art.

CONVEX REAR HUB WALL SECTION

Figure 2:
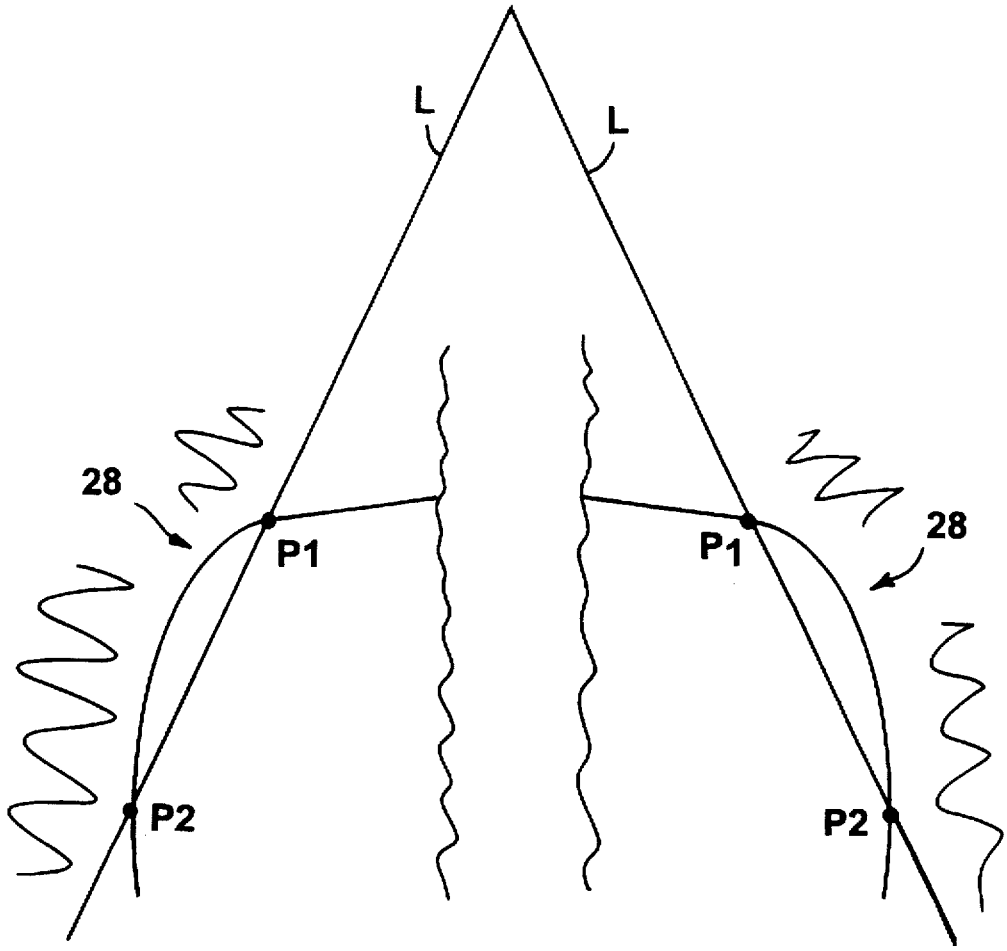
FIG. 2 is a diagrammatic representation of the camber of the convex rear inner envelope wall.

Inner envelope surface 21 has a generally axial section 27' and a rear terminus section 28. Section 28 curves gradually to rear wall 30 transverse to the fan axis. Section 28 is convex, with a gradually increasing radius as it moves rearwardly. The envelope wall is termed convex over a given region if it forms a generally continuous curve that is essentially contained within the limits created by straight lines connecting the front of the wall region with the rear of the wall region. FIG. 2 illustrates a convex wall 28, which is contained within the lines L between points $P_1$ and $P_2$. The region of airflow is shaded and lines entirely outside line L between points $P_1$ and $P_2$.

Figure 3:
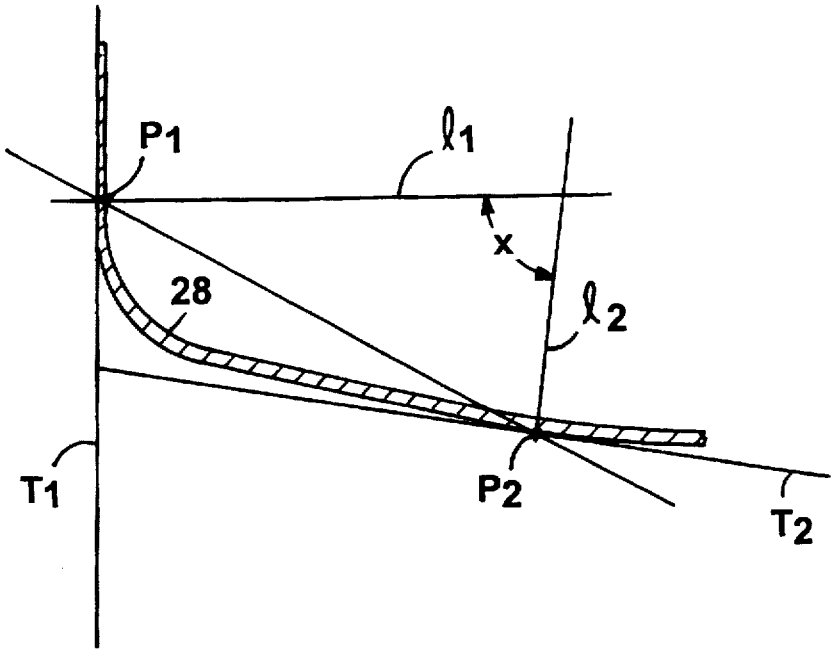
FIG. 3 depicts certain characteristics of a convex envelope wall.

More specifically, the illustrated embodiment has a radius section 28' connecting axial section 27' to a section 28" whose radius of curvature increases monotonically (at a generally constant rate) to a segment having a radius of ½ the radius at section 27'. Generally, the change in the radius of curvature between two points can be understood as the angle $\phi$ between tangents to the points. Similarly the camber angle X in this context is the angle between a line $l_1$, perpendicular to tangent $T^1$ and a line $l_2$ perpendicular to the next tangent $T^2$. See FIG. 3.

The second stage of stators 26 extends into rear terminus section.

INJECTION MOLDING AND ASSEMBLY

Envelope 16 is made of three injection molded parts.

The first part 16A forms the outer wall of the forward part of the envelope. It includes a rounded inlet 32, a labyrinth 34, and a transition 36 of increasing radius. At its rear terminus, part 16A includes a step 38 to accommodate part of the outer wall of the second injection molded part 40 as described below.

The second injection molded part 40 consists of inner wall 44 from which the first stator vane stage 24 extends and connects to outer wall 46. Outer wall 46 forms part of the inner surface of the outer wall of the envelope. Inner wall 44 extends to a forwardly positioned rounded nose 42 and from there to a forward motor mount 48. Nose 42 is designed to accommodate the rearward tip of the blades 15 of wheel 14, including balancing clips that are attached to those blade tips.

The third injection molded part 50 has an outer wall 52 extending rearwardly from the rear terminus of part 16A at step 38. Wall 52 includes a step 54 that continues step 46, and together, steps 54 and 38 accommodate the outer wall of part 40.

Part 50 also includes the generally axial inner envelope wall 27 segment described above. The second stage of vanes 26 spans between the inner and outer portions of part 50. Part 50 also includes a rear motor mount 52.

The blower parts are assembled by sandwiching the second part 40 between part 16A and 50; Motor 12 is also secured by mounts 48 and 52 in central recess 60 formed by part 40 and part 50. Part 16A is fastened to part 50 at external bosses (e.g. 56) on the outer perimeter of the envelope. Part 40 is fastened to part 50 through internal cavities (e.g. cavities 49 and 59).

Part 40 has a hub diameter that is between 1% and 4% larger than that of part 50. This feature reduces power consumption, improving noise and efficiency; it also facilitates assembly as described above, because the motor can be inserted in a recess in the second injection molded part, after which the third injection molded part is added at the rear of the motor, overlapping the second injection molded part.

IMPROVED LEAKAGE CONTROL VANES

There will be recirculating airflow around the blade tips through the labyrinth 34, with two major vortical components—the rotary motion of the fan imparts large scale vorticity, i.e., with diameter approximately equal to that of the fan, to the recirculation flow, with the vortical axis substantially aligned with the fan axis.

As it passes through the fan, the recirculating vorticity interacts with the fan blades and generates audible tones at the blade passing frequency and harmonics thereof. Such tones can be annoying; more importantly, they deplete energy from the system, thereby making the fan less efficient.

The blower assembly 10 also includes an inlet defining front surface which forms a running clearance with the impeller blades through which recirculating airflow passes before joining the mainstream airflow. The inlet section further comprises stationary recirculation control vanes 17 (one shown), positioned to encounter recirculating airflow before it exits from the running clearance. The inlet recirculation flow control vanes have edges 17A of each vane that are chisel shaped, with the sharp edge tangentially upstream. In preferred embodiments, each vane is slightly rotated from a radial orientation with the radially inward end of each vane being rotated upstream relative to the swirl introduced by the blower, e.g. by an angle of between 8 and 15 degrees. The forward envelope part may also include labyrinth 34 which interdigitate with corresponding labyrinth members 9 on the blades.

Specifically, the angle at which the recirculation flow approaches the inlet stators is important. The recirculation flow will have a tangential component due to large scale vorticity, and an axial component due to the pressure differential across the fan. Part 16*a* includes inlet leakage stator vanes (one shown as 17). I have found an improved vane geometry in which the vanes are chisel shaped, with the sharp edge 17A facing the incoming airflow.

Those skilled in the art will recognize that there are other embodiments within the following claims.

What is claimed is:

1. A centrifugal blower assembly for mounting adjacent a heat exchanger, the blower comprising:

a) an impeller mounted to rotate on an axis, the impeller comprising multiple blades which draw air in through a central inlet and force air outward; and b) an annular envelope positioned around the impeller to receive airflow from the impeller and direct airflow out of a discharge; the envelope comprising, i) an axially forward inlet section positioned to receive airflow from the impeller, ii) a flow-directing envelope section, bounded by an inner envelope surface and an outer envelope surface, the flow directing envelope section being positioned behind the inlet section and extending rearwardly to an annular outlet, the flow-directing section comprising two stages of airfoil vanes positioned in the annular envelope to turn and diffuse airflow in the envelope;

the blower being further characterized in that the inner envelope surface includes a convex rearward terminal section curving gradually from a generally axial segment to a rear wall that is transverse to the axis, whereby the heat exchanger is positioned adjacent the rear wall.

2. The assembly of claim 1 in which the rearward terminal section of the convex inner envelope surface is characterized by a gradually increasing radius of curvature moving rearwardly.

3. The assembly of claim 1 in which the convex section has a camber between 70° and 90° in a region between the generally axial segment of the inner envelope surface and a point at which the surface has a radius of 0.5 Rh, where Rh is the radius of the generally axial segment of the inner envelope surface.

4. The assembly of claim 1 in which the convex section is a curve having a radius of curvature that increases at a generally constant rate in regions between the generally axial segment and a point at which the surface has a radius of 0.5 Rh.

5. The assembly of any one of claims 1–4 in which:

the first of the airfoil vane stages is positioned axially ahead of a second of the stages, and at least a portion of vanes of the second stage extend along at least part of the convex rearwardly terminal section of the inner envelope surface.

6. The assembly of claim 1 in which the convex region has a shallow cone region shape.

7. The assembly of claim 1 in which a first injection molded part comprising the first stage of stator vanes has a hub diameter that is between 1% and 4% larger than a second injection molded part comprising the second stage of stator vanes, permitting a motor to be inserted into the assembly with the first injection molded part, after which the second injection molded part is added at the rear of the motor, overlapping with the first injection molded part.

8. The assembly of claim 1 further comprising an impeller wheel comprising, i) multiple blades which draw air in through a central inlet and force air outward, ii) an annular top plate positioned to cap an annular segment of the forward edges of the impeller blades, and iii) a hub plate positioned to cap the rear edges of the impeller blades; and the top plate forms a top plate angle with a plane perpendicular to the blower axis between 12° and 30° and the hub plate forms a hub plate angle with a plane perpendicular to the blower axis between 0° and 30°.

9. A centrifugal blower assembly for mounting adjacent a heat exchanger, the blower comprising:

a) an impeller mounted to rotate on an axis, the impeller comprising multiple blades which draw air in through a central inlet and force air outward; and b) an annular envelope positioned around the impeller to receive airflow from the impeller and direct airflow out of a discharge; the envelope comprising, i) an axially forward inlet section positioned to receive airflow from the impeller, ii) a flow-directing envelope section, bounded by an inner envelope surface and an outer envelope surface, the flow directing envelope section being positioned behind the inlet section and extending rearwardly to an annular outlet, the flow-directing section comprising two stages of airfoil vanes positioned in the annular envelope to turn and diffuse airflow in the envelope;

the blower being further characterized in that the inner envelope surface includes a convex rearward terminal section curving gradually from a generally axial segment to a rear wall that is transverse to the axis, whereby the heat exchanger is positioned adjacent the rear wall a first injection molded part comprising the first stage of stator vanes having a hub diameter that is between 1% and 4% larger than a second injection molded part comprising the second stage of stator vanes, permitting a motor to be inserted into the assembly with the first injection molded part, after which the second injection molded part is added at the rear of the motor, overlapping with the first injection molded part.

10. A centrifugal blower assembly for mounting adjacent a heat exchanger, the blower comprising:

a) an impeller mounted to rotate on an axis, the impeller comprising multiple blades which draw air in through a central inlet and force air outward; and b) an annular envelope positioned around the impeller to receive airflow from the impeller and direct airflow out of a discharge; the envelope comprising, i) an axially forward inlet section positioned to receive airflow from the impeller, ii) a flow-directing envelope section, bounded by an inner envelope surface and an outer envelope surface, the flow directing envelope section being positioned behind the inlet section and extending rearwardly to an annular outlet, the flow-directing section comprising two stages of airfoil vanes positioned in the annular envelope to turn and diffuse airflow in the envelope;

the blower being further characterized in that the inner envelope surface includes a convex rearward terminal section curving gradually from a generally axial segment to a rear wall that is transverse to the axis, whereby the heat exchanger is positioned adjacent the rear wall, the assembly further comprising an impeller wheel comprising, i) multiple blades which draw air in through a central inlet and force air outward, ii) an annular top plate positioned to cap an annular segment of the forward edges of the impeller blades, and iii) a hub plate positioned to cap the rear edges of the impeller blades; and the top plate forms a top plate angle with a plane perpendicular to the blower axis between 12° and 30° and the hub plate forms a hub plate angle with a plane perpendicular to the blower axis between 0° and 30°.

11. A centrifugal blower assembly comprising:

a) an impeller wheel mounted to rotate on an axis, the impeller wheel comprising, i) multiple blades which draw air in through a central inlet and force air outward, ii) an annular top plate positioned to cap an annular segment of the forward edges of the impeller blades, and iii) a hub plate positioned to cap the rear edges of the impeller blades; and b) an annular envelope positioned around the impeller to receive airflow from the impeller blades and direct airflow out of a discharge; the envelope comprising, i) an axially forward inlet section positioned to receive airflow from the impeller, and ii) a flow-directing envelope section, bounded by an inner envelope surface and an outer envelope surface, the flow directing envelope section being positioned behind the inlet section and extending rearwardly to an annular outlet, the flow-directing section comprising two stages of airfoil vanes positioned in the annular envelope to turn and diffuse airflow in the envelope;

the assembly being characterized in that the top plate forms a top plate angle with a plane perpendicular to the blower axis between 12° and 30° and the hub plate forms a hub plate angle with a plane perpendicular to the blower axis between 0° and 30°.

12. The assembly of claims 10 or 11 in which the top plate angle is between 12° and 30°.

13. The assembly of claims 10 or 11 in which the top plate angle is 21°±2°.

14. The assembly of claims 10 or 11 in which the hub plate angle is between 0° and 12°.

15. The assembly of claims 10 or 11 in which the hub plate angle is about 6°±2°.

16. The assembly of claims 10 or 11 in which the impeller blades are rearwardly curved and the top plate angle is at least 20°.

17. A centrifugal blower assembly comprising:

a) an impeller mounted to rotate on an axis, the impeller comprising multiple blades which draw air in through a central inlet and force air outward; and b) an annular envelope positioned around the impeller to receive airflow from the impeller and direct airflow out of a discharge; the envelope comprising, i) an axially forward inlet section configured to receive airflow from the impeller, ii) a flow-directing envelope section, bounded by an inner envelope surface and an outer envelope surface, the flow-directing envelope section being positioned behind the inlet section and extending rearwardly to an annular outlet, the flow directing section comprising a first stage of airfoil vanes positioned in the annular envelope to turn and diffuse airflow in the envelope and a second stage of airfoil vanes positioned in the envelope rearward of the first stage, the blower being further characterized in that the first stage of stator vanes has a hub diameter that is between 1% and 4% larger than the second stage of stator vanes.

18. The assembly of claim 17 further comprising an impeller wheel comprising, i) multiple blades which draw air in through a central inlet and force air outward, ii) an annular top plate positioned to cap an annular segment of the forward edges of the impeller blades, and iii) a hub plate positioned to cap the rear edges of the impeller blades; and the top plate forms a top plate angle with a plane perpendicular to the blower axis between 12° and 30° and the hub plate forms a hub plate angle with a plane perpendicular to the blower axis between 0° and 30°.

* * * * *

UNITED STATES PATENT AND TRADEMARK OFFICE

CERTIFICATE OF CORRECTION

PATENT NO. : 5,743,710

DATED : April 28, 1998

INVENTOR(S) : Martin G. Yapp

It is certified that error appears in the above-identified patent and that said Letters Patent is hereby corrected as shown below:

On the title page, item [56] insert the following

OTHER DOCUMENTS

| | | |
|---|---|---|
| | | PCT Search Report for PCT/US97/03020 dated 4/15/97. |
| | | |

Signed and Sealed this

Ninth Day of February, 1999

*Attest:*

*Acting Commissioner of Patents and Trademarks*

*Attesting Officer*